US005270478A

United States Patent [19]

Ichiki Tetsuji et al.

[11] Patent Number: 5,270,478

[45] Date of Patent: Dec. 14, 1993

[54] DAMP CONTROL IN AN ELECTRONIC MUSICAL

[75] Inventors: Ichiki Tetsuji; Koichi Kozuki; Kazuhisa Okamura, all of Hamamatsu, Japan

[73] Assignee: Yamaha Corporation, Hamamatsu, Japan

[21] Appl. No.: 754,562

[22] Filed: Sep. 4, 1991

[30] Foreign Application Priority Data

Sep. 6, 1990 [JP] Japan ..... 2-234408

[51] Int. Cl.[5] ..... G10H 1/057; G10H 1/22; G10H 1/46

[52] U.S. Cl. ..... 84/627; 84/633; 84/656; 84/DIG. 2

[58] Field of Search ..... 84/618, 627, 633, 656, 84/663, 665, 684, 702, 703, 711, 738, 741, 742, DIG. 2

[56] References Cited

U.S. PATENT DOCUMENTS 4,928,569 5/1990 Kudo et al. ..... 84/627 X 5,074,185 12/1991 Nishikawa et al. ..... 84/627

*Primary Examiner*—Stanley J. Witkowski

*Attorney, Agent, or Firm*—Spensley Horn Jubas & Lubitz

[57] ABSTRACT

When a new tone is to be assigned to a certain channel, an amplitude level of a preceding tone signal which is being produced in this channel is detected and a damp rate is determined on the basis of the detected amplitude level. Tone volume of the preceding tone signal is rapidly attenuated in accordance with the damp rate thus determined and, thereafter, generation of a new tone signal is started. The damp rate thereby is variably controlled in accordance with the magnitude of tone volume level of the preceding tone signal during a damp control and both optimum prevention of a click noise and a very quick rapid attenuation control corresponding to the tone volume level can be realized. The invention is applicable not only to a damp control of tone volume of a tone but also to a damp control of an envelope shape signal used for other control purposes.

5 Claims, 3 Drawing Sheets

DAMP CONTROL IN AN ELECTRONIC MUSICAL

BACKGROUND OF THE INVENTION

This invention relates to a tone control device used in an electronic musical instrument or other device for generating, controlling or processing a tone and, more particularly, to a damp control of a tone volume or an envelope shape signal at a different rapid attenuation rate (i.e., damp rate) corresponding to a current value of an amplitude level of a tone signal or a level of an envelope shape signal used for tone control.

A control for rapidly attenuating a tone volume envelope of a tone is called "forcing damp" and is known by, for example, Japanese Preliminary Patent Publication No. 58-65489. In a case where, in a truncate processing in a key assigning processing, it is desired to cancel a tone which is being sounded in a certain channel and assign another tone to the channel for newly sounding the tone, the "forcing damp" control is applied to the old tone which has been assigned to the channel until then. This dample control is applied not only to a tone volume envelope but also to an envelope shape signal used for tone control. The "forcing damp" control is applied also to processing other than the truncate processing when necessary (e.g., when a damp operator is operated).

In the prior art "forcing damp" control, a damp rate, i.e., inclination of rapid attenuation, is constant regardless of magnitude of a current tone volume level of a tone signal or a current level of an envelope shape signal. For this reason, when a high damp rate is adopted and the inclination of rapid attenuation thereby is made steep, a click noise will be produced to an appreciable degree if the current level is high. On the other hand, when the current level is low, no appreciable click noise will be produced even if the inclination of rapid attenuation is steep. Conversely, when a low damp rate is adopted and the inclination of rapid attenuation thereby is made gradual, occurrence of an appreciable amount of click noise can be prevented even when the current level is high. When a low damp rate is adopted and the current level is small, however, the inclination of rapid attenuation is made gradual notwithstanding that it is unnecessary. Hence, in this case, there arises the problem that an unnecessarily long attenuation time is spent.

SUMMARY OF THE INVENTION

It is, therefor, an object of the invention to provide a tone control device which is capable of variably controlling the damp rate in accordance with the magnitude of a tone volume level of a tone signal or of a level of an envelope shape signal which is current at the time of a damp control and realizing both an optimum prevention of a click noise and a rapid attenuation control in accordance with a current level.

The tone control device according to the invention comprises a circuit for detecting an amplitude level of a tone signal, a damp rate determination circuit for determining a rapid attenuation rate to be followed during a damp control in accordance with the detected level, and a damp control circuit for rapidly attenuating a volume of a tone at the determined damp rate when the volume of the tone should be rapidly attenuated. The amplitude level of a tone signal may be detected on the basis of the level of an envelope shape signal for setting a tone volume or may be detected by measuring an actual amplitude level of a tone signal which has been controlled in its tone volume by this envelope shape signal.

In one aspect of the invention, the tone control device comprises a circuit for detecting the level of an envelope shape signal for tone control, a damp rate determination circuit for determining a rapid attenuation rate to be followed during a damp control in accordance with the detected level, and a damp control circuit for rapidly attenuating the envelope shape signal at the determined rate when a tone volume of a tone should be rapidly attenuated. The envelope shape signal in this case is not an envelope shape signal for setting a tone volume level but one for controlling tone elements such as tone color. A damp rate control may be applied also to this case in a similar manner to the above mentioned.

For instance, a damp rate control is made so that the larger the amplitude level of a tone signal is, the lower the rapid attenuation rate, i.e., the damp rate is set, whereas the smaller the amplitude level of a tone signal is, the higher the damp rate is set. By this arrangement, when the amplitude level of a tone signal is relatively high during the damp control, the inclination of rapid attenuation becomes relatively gradual and occurrence of a click noise can be prevented. When, conversely, the amplitude level of a tone signal is relatively low during the damp control, the inclination of rapid attenuation becomes relatively steep and, consequently, rapid attenuation can be quickly completed in addition to the fact that a click noise occurring in this case does not reach an appreciable level.

A preferred embodiment of the invention will be described with reference to the accompanying drawings.

BRIEF DESCRIPTION OF THE DRAWINGS

In the accompanying drawings.

DESCRIPTION OF A PREFERRED EMBODIMENT

Figure 1:
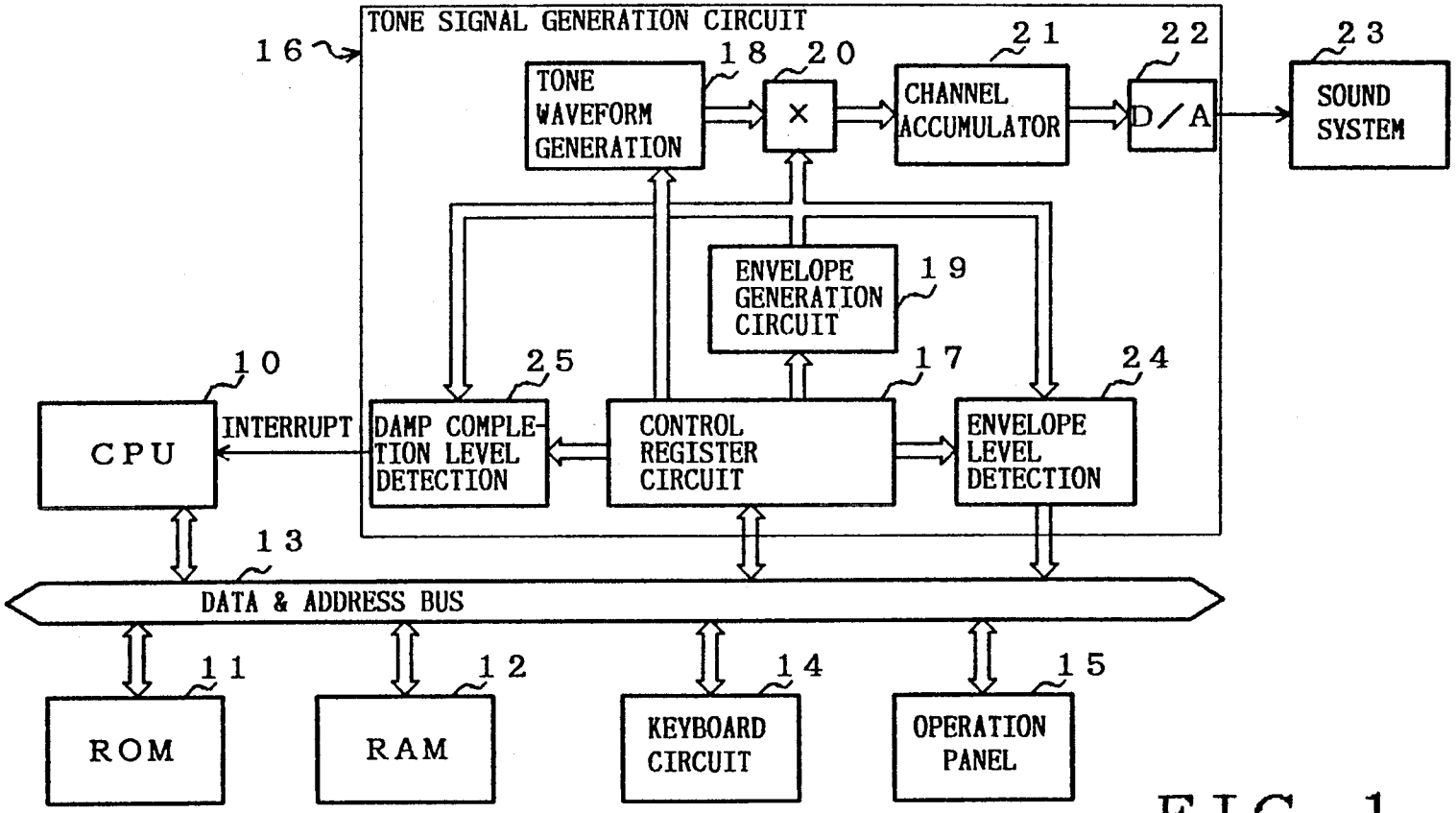
FIG. 1 is a block diagram showing an example of a hardware construction of an electronic musical instrument incorporating the tone control device according to the invention.

FIG. 1 is a block diagram showing a hardware construction of an example of an electronic musical instrument incorporating the tone control device of the invention. In this embodiment, various processings are executed under control of a microcomputer including a central processing unit (CPU) 10, a data and program ROM 11 and a data and working RAM 12. A keyboard circuit 14, an operation panel 15 and a tone signal generation circuit 16 are connected to the microcomputer through a data and address bus 13.

The keyboard circuit 14 is provided in correspondence to a keyboard including keys for designating tone pitches of tones to be generated and includes key switches corresponding to respective keys on the keyboard.

The operation panel 15 includes various operators and switches for selecting, setting and controlling tone color, tone volume, tone pitch, effects etc.

The tone signal generation circuit 16 generates tone signals in plural channels. A control register circuit 17 is connected to the data and address bus 13 to exchange data with the microcomputer. Data necessary for generating tone signals for plural channels is stored in the control register circuit 17 and necessary data is supplied from the control register circuit 17 to the tone signal generation circuit 18 and an envelope generation circuit 19. The tone waveform generation circuit 18 generates tone waveform signals of tones which have been assigned to the respective channels. For generating tone waveforms, any system may be adopted from among known systems such as the waveform memory reading system, FM synthesis system and AM synthesis system. Tone signals corresponding to the respective channels may be generated on a time shared basis or in parallel. The envelope generation circuit 19 generates envelope shape signals for determining tone volume amplitude levels of tones which have been assigned to the respective channels. As is well known, this envelope shape signal determines a tone volume amplitude level change having attack, decay, sustain and release characteristics. As is also well known, upon introducing a damp mode when it is required for implementing a truncate processing operating a damp operator, the level of the envelope shape signal can be rapidly attenuated.

A multiplier 20 multiplies a tone waveform signal which has been generated by the tone waveform generation circuit 18 with an envelope shape signal generated by the envelope generation circuit 19 for the corresponding channel to thereby determine a tone volume amplitude level of the tone. The output of the multiplier 20 is supplied to a channel accumulator 21 where tone waveform sample data of all channels are totalled. The totalled tone waveform sample data is converted by a digital/analog converter 22 to an analog signal and supplied to a sound system 23.

The envelope shape signals of the respective channels generated by the envelope shape generator 19 are stored in an envelope level detection register 24. The contents stored in this register 24 are constantly renewed and thereby indicate a current level of the envelope shape signal of each channel. The data stored in the register 24 is supplied to the data and address bus 13 so that it may be referred to any time from the microcomputer side.

The level of the envelope shape signal of each channel generated by the envelope shape generation circuit 19 is watched by a damp completion level detection circuit 25. The damp completion level detection circuit 25 detects falling of the level of the envelope shape signal below a predetermined small level corresponding to the damp completion level during the damp control. Upon detection of the damp completion level by this circuit 25, an interruption signal is given to the CPU 10 and a predetermined interrupting processing is thereby executed.

An example of processings executed by the microcomputer will now be described with reference to the flow charts of FIGS. 2 to 4.

Figure 2:
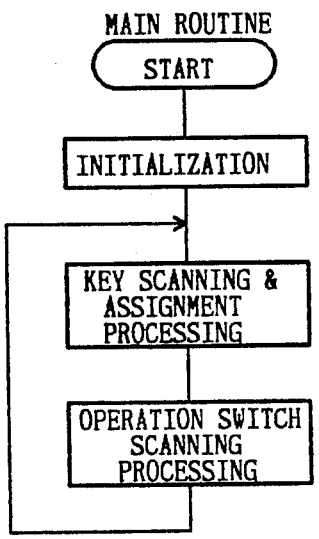
FIG. 2 is a flow chart showing an example of main routine executed by a microcomputer of FIG. 1.

FIG. 2 shows an example of the main routine. In "key scanning and assignment processing", key switches in the keyboard circuit 14 are scanned for detection of their on-off states and a depressed key is assigned to any of tone generation channels. There are "key-on event processing" and "key-off event processing" in this "key scanning and assignment processing". Examples of the "key-on event processing" and "key-off event processing" are shown in FIGS. 3 and 4, respectively. In "key-on event processing", when a key has been newly depressed, generation of a tone corresponding to the key is newly assigned to a suitable channel. The "key-off event processing" is a processing which is performed when a key has newly been released.

In "operation switch scanning processing", various operators and switches on the operation panel 15 and other operation switches are scanned for detection of their on-off states and various processings are performed on the basis of the detection.

Figure 5:
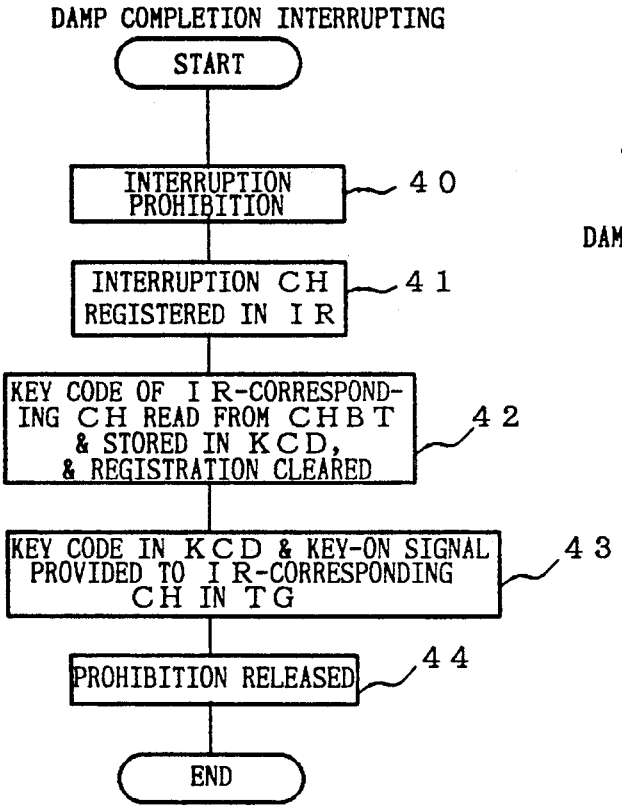
FIG. 5 is a flow chart showing an example of a damp completion interrupting routine.

When a predetermined interrupting signal has been given in the course of the main routine, a damp completion interrupting routine of FIG. 5 is executed.

The "key-on event processing" will be described with reference to FIG. 3. First, the key code of a newly depressed key is registered in a new key code register KCD (step 30). Then, a processing for determining a channel to which the newly depressed key should be assigned is performed and the channel number of the determined channel is stored in a channel register AS (step 31). This channel-for-assignment determining processing may be performed in accordance with a suitable assignment standard. This assignment standard per se is well known so that detailed description thereon will be omitted. For example, an empty channel which is currently not used for tone generation is detected and this empty channel is determined as the channel to which a newly depressed key should be assigned. In case there is no empty channel or regardless of presence or absence of an empty channel, a predetermined truncate channel detection processing is performed and a thus-detected truncate channel is determined as the channel to which a newly depressed key should be assigned. As for detecting a truncate channel, various methods are known such, for example, as a method according to which a channel in which attenuation of a tone signal amplitude level has advanced to the furthest degree is detected as the truncate channel or a method according to which a channel of the oldest released key is detected as the truncate channel. Any of these known methods may be adopted and detailed description thereof will be omitted. In the flow charts, a channel is abbreviated as CH.

When a channel to which a newly depressed key should be assigned has been determined, there is possibility that another tone associated with previously depressed key (hereinafter referred to as "preceding tone") has already been assigned to this channel. In this case, sounding of the preceding tone should be cancelled by rapidly attenuating the tone volume amplitude level of the preceding tone. For this purpose, a rapid attenuation control, i.e., damp control, is performed.

In next step 32, contents of the envelope level detection register 24 in the tone generation circuit 16 (abbreviated as TG in the flow charts) are referred to and a current tone signal amplitude level, i.e., envelope shape signal amplitude level (abbreviated as EG level) in a channel corresponding to a newly assigned channel designated by the data of the register AS is received and stored in a detected level register LVL.

Figure 6:
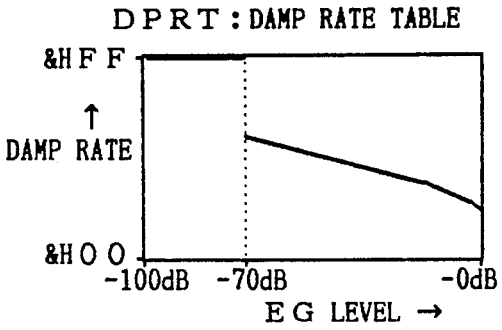
FIG. 6 is a diagram showing an example of a function of damp rate data to an envelope shape signal level.

In the ROM 11 or RAM 12, there is provided a damp rate table DPRT. This damp rate table DPRT stores function of damp rate data to the envelope shape signal amplitude levels. An example of the damp rate table DPRT is shown in FIG. 6. In the figure, abscissa represents the amplitude level of the envelope shape signal. The value of the level is expressed by a negative decibel representation, the maximum level being 0 dB. In the figure, ordinate represents damp rate data. The magnitude of the value of this damp rate data expressed in hexadecimal notation corresponds directly to the magnitude of the damp rate.

Figure 3:
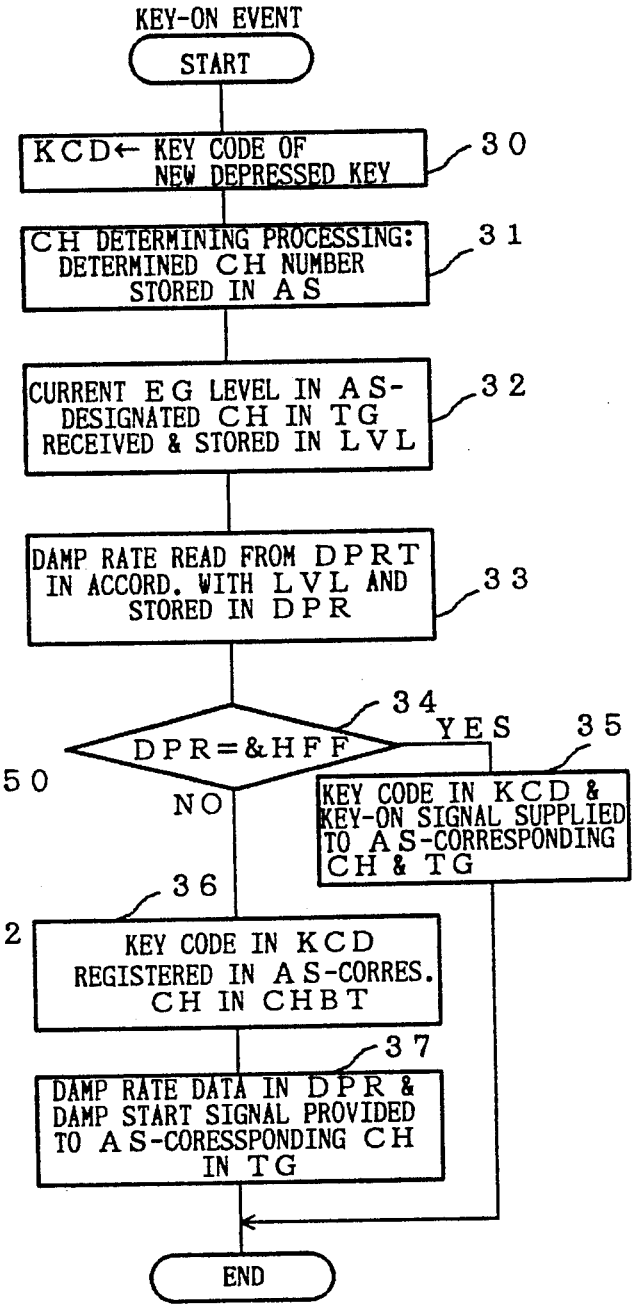
FIG. 3 is a flow chart showing an example of "key-on event processing" executed in "key scanning and assignment processing" of FIG. 2.
Figure 4:
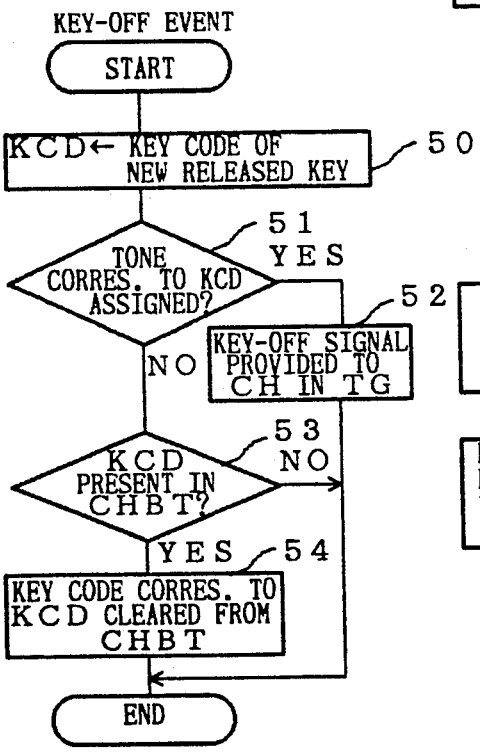
FIG. 4 is a flow chart showing an example of "key-off event processing" executed in "key-scanning and assignment processing" of FIG. 2.

In FIG. 3, in step 33, the damp rate data is read from the damp rate table DPRT in accordance with the current envelope shape signal amplitude level stored in the detected level register LVL whereby the damp rate is determined. The read out damp rate data is stored in a damp rate register DPR.

In next step 34, whether or not the value of the damp rate data stored in the damp rate register DPR is a maximum value &HFF is examined. In the example of FIG. 6, the value of the damp rate becomes the maximum value &HFF when the envelope shape signal amplitude level is below-70 dB (i.e., almost 0 level). In this case, no special damp control is made but the routine proceeds to step 35 in which a processing for immediately starting sounding of a new tone in the new assigned channel designated by the data of the register AS is performed. More specifically, the key code of the new tone stored in the new key code register KCD and the key-on signal are supplied to the assigned channel for the new tone determined by the register AS and the key code and the key-on signal are stored in the control register circuit 17 of the tone signal generation circuit 16. In response to this, the tone waveform generation circuit 18 and the envelope generation circuit 19 in the tone signal generation device 16 start generation of a tone waveform signal having the tone pitch of the new tone and a new envelope shape signal in the channel to which the new tone has been assigned.

When the value of the damp rate data stored in the damp rate register DPR is not the maximum value &HFF, the routine proceeds from NO of step 34 to step 36 for performing the damp control. First, in step 36, the key code of the new tone stored in the new key code register KCD is registered at a channel position corresponding to the newly assigned channel designated by the register AS. The fact that the key code has been registered in correspondence to a proper channel in this table CHBT signifies that damping of a preceding tone in this channel is currently being performed and that assignment of the new tone corresponding to this key code in this channel has been reserved but sounding of the new tone has not been started yet.

Figure 7:
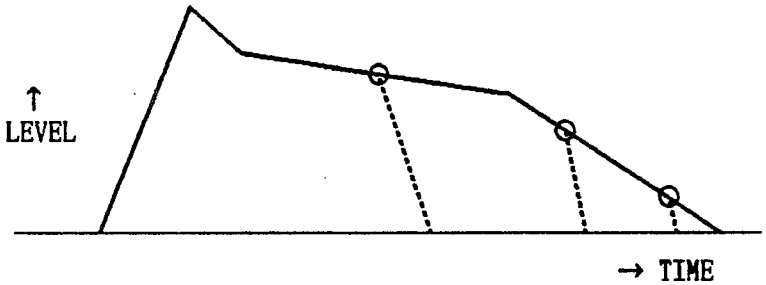
FIG. 7 is a diagram of an envelope shape showing an example in which the damp rate changes in accordance with the magnitude of the envelope shape signal level at the start of damp.

In next step 37, the damp rate data stored in the damp rate register DPR and a start signal are provided to the channel designated by the register AS to which the new tone has been assigned and these data are stored in the control register circuit 17 of the tone signal generation circuit 16. The envelope generation circuit 19 in the tone signal generation circuit 16 thereby is caused to switch the envelope shape signal generation mode of the former tone which is being sounded in the channel in which assignment of the new tone has been reserved to the damp mode so that the level of the envelope shape signal is rapidly attenuated at a rate according to the provided damp rate. In this case, the higher the level of the envelope shape signal immediately before switching to the damp mode is, the lower the damp rate is, so that the inclination of rapid attenuation is relatively gradual. Conversely, the lower the level of the envelope shape signal immediately before switching to the damp mode is, the higher the damp rate is, so that the inclination of rapid attenuation is relatively steep, i.e., the level attenuates very rapidly. This state is illustrated in FIG. 7 in which the solid line indicates an example of an original envelope shape and circles indicate damp starting points. In FIG. 7, several different envelope shape levels are illustrated. The dotted lines indicate change of the envelope shape which is rapidly attenuated by the damp processing.

When the level of the envelope shape signal which is rapidly attenuated in the damp mode has fallen below a predetermined small level (e.g., below-70 dB), a damp completion level detection circuit 25 in the tone signal generation circuit 16 generates an interrupting signal corresponding to this channel. A damp completion interrupting routine shown in FIG. 5 thereby is executed.

In FIG. 5, further interruption is prohibited (step 40) and then the number of the channel in which the interrupting signal has been generated (i.e., the channel in which damping has been completed) is registered in a register IR (step 41). Nextly, a key code among key codes registered in the new tone assignment reservation table CHBT which is of the same channel as the channel registered in the register IR in which damping has been completed is read out and stored in the new key code register KCD and the registration of this key code in the table CHBT is cleared (step 42).

In next step 43, the key code stored in the key code register KCD and key-on signal of the new tone are provided to the channel designated by the register IR in which damping has been completed, i.e., the channel to which the new tone should be assigned, and these data are stored in the control register 17 in the tone signal generation circuit 16. The tone waveform generation circuit 18 and envelope generation circuit 19 of the tone signal generation circuit 16 thereby are caused to start generation of a tone waveform signal having the tone pitch of the new tone in the channel for the new tone in which the former tone has completed rapid attenuation and start generation of a new envelope shape signal. In step 44, prohibition of interruption which has been introduced in step 40 is released.

The "key-off event processing" will now be described with reference to FIG. 4. First, the key code of a newly released key is registered in the register KCD (step 50). Then, whether or not a tone corresponding to the key code registered in the register KCD has been assigned to any channel is examined (step 51). If the answer is YES, a key-off signal is provided in correspondence to the channel to which the key code of the newly released key has been assigned and is stored in the control register circuit 17 of the tone signal generation circuit 16 (step 52). The envelope generation circuit 19 thereby is caused to perform necessary processing such as starting release of the envelope shape signal which is being produced in this channel.

When the tone corresponding to the key code of the newly released key registered in the register KCD has not been assigned to any channel, the routine proceeds from NO of step 51 to step 53 where whether or not a key code which is the same as this key code has been registered in the new tone assignment reservation table CHBT is examined. When a key of a new tone has been released during reservation of the new tone assignment, i.e., during damping of a preceding tone, this step 53 becomes YES and the routine proceeds to step 54. In step 54, registration of the key code in the new tone assignment reservation table CHBT is cleared.

In the above described embodiment, the amplitude level of a tone signal is detected on the basis of the level of an envelope shape signal for determining a tone volume. The invention is not limited to this but the amplitude level of a tone signal may be detected by measuring an actual amplitude level (e.g., output level of the multiplier 20) of a tone signal which has been controlled in tone volume by the tone volume setting envelope shape signal.

In the above described embodiment is shown the example in which the damp control is performed in the truncate processing during key assignment. The invention is not limited to this but it is applicable to a damp control made in other cases. For example, this invention may be applied to a case where a damp control is made by operating a damper operator.

This invention is applicable not only to a case where the tone volume amplitude level of a tone signal should be damped but also to a case where a damp control is performed on an envelope shape signal for setting tone elements other than tone volume, such as tone color. In that case, an envelope shape signal which is used not for controlling the tone volume amplitude but for other tone control purpose may also be generated in the envelope generation circuit 19 of FIG. 1 and a current level of this envelope shape signal for other tone control purpose may be stored in the envelope level detection register 24. The invention can be implemented in this case also with a construction similar to the above described embodiment.

The function of damp rate data to the amplitude level of an envelope shape signal is not limited to the one shown in FIG. 6 but may be determined in a suitable manner.

For generating an envelope shape in the envelope generation circuit 19, any system such as the waveform memory system or operation system may be employed. In that case, variable control of damp rate corresponding to the magnitude of damp rate data may be realized by a suitable method such as variable control of read or operation clock frequency or variable control of value of increment or decrement change width data in repeated addition or subtraction. Data expression of a generated envelope shape signal may be a linear expression or a logarithmic expression.

As described above, according to the invention, the damp rate can be variably controlled in accordance with the magnitude of a tone volume level of a tone signal or an envelope shape signal level which is current at the time of the damp control and, accordingly, prevention of a click noise and a prompt attenuation control can be realized in an optimum form in accordance with a current level.

We claim:

1. A tone control device for controlling a tone signal comprising:

detection means for detecting an amplitude level of the tone signal;

damp rate data providing means having a table storing plural damp rate data corresponding to plural tone amplitude levels, and for reading damp rate data from said table in accordance with the amplitude level detected by said detection means;

damp control means for rapidly attenuating a tone volume of the tone signal on the basis of the damp rate data when a damp control of the tone signal is to be effected; and means for inhibiting rapid attenuation by said damp control means when the amplitude level of the tone signal is less than a predetermined value.

2. A tone control device as defined in claim 1, wherein said damp rate data providing means provides the damp rate data in such a manner that the higher the level of the detected amplitude level is, the smaller a rate of attenuating a tone volume of the tone signal becomes.

3. A tone control device as defined in claim 1, wherein said detection means detects the amplitude level of the tone signal on the basis of a current level of an envelope thereof.

4. An electronic musical instrument comprising:

tone designation means for designating a tone to be generated;

tone assigner means for assigning generation of the tone which has been designated by said tone designation means to one tone generation channel of plural tone generation channels;

tone signal generation means for generating a tone signal corresponding to the tone which has been assigned to said one tone generation channel;

detection means for detecting a tone volume amplitude level of a first tone signal which was previously assigned to said one tone generation channel when a second tone signal newly designated by said tone designation means is assigned to said one tone generation channel by said tone assigner means;

damp rate determination means for determining a damp rate in accordance with the tone volume amplitude level of the first tone signal detected by said detection means;

damp control means for performing a rapid attenuation control to rapidly attenuate volume of the first tone signal which is being produced in said channel at a damp rate determined by said damp rate determination means;

first control means for starting generation of the newly designated tone signal when the rapid attenuation control by said damp control means has ended; and second control means for immediately starting generation of the second tone signal without the rapid attenuation control being performed by said damp control means when the damp rate determined by said damp rate determination means is greater in value than a predetermined value.

5. A tone control device for controlling an envelope shape signal for a tone control comprising:

detection means for detecting a level of the envelope shape signal;

damp rate data providing means having a table storing plural damp rate data corresponding to plural envelope levels, and for reading damp rate data from said table in accordance with the level detected by said detection means;

damp control means for rapidly attenuating the envelope shape signal on the basis of said damp rate data when a damp control of the envelope shape signal is to be effected; and means for inhibiting rapid attenuation by said damp control means when the level of the envelope shape signal is less than a predetermined value.

* * * * *